US006991500B1

(12) United States Patent
Gulko et al.

(10) Patent No.: US 6,991,500 B1
(45) Date of Patent: Jan. 31, 2006

(54) COWL LATCHING MECHANISM FOR AN OUTBOARD MOTOR

(75) Inventors: Marc A. Gulko, Oshkosh, WI (US); Timothy D. Krupp, Fond du Lac, WI (US); Thomas J. Walczak, Oconomowoc, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/070,760

(22) Filed: Mar. 2, 2005

(51) Int. Cl.
*B63H 20/32* (2006.01)

(52) U.S. Cl. ..... 440/77; 123/195 P

(58) Field of Classification Search ..... 440/77; 123/195 P, 198 E
See application file for complete search history.

(56) References Cited

U.S. PATENT DOCUMENTS

| | | | | |
|---|---|---|---|---|
| 3,955,526 A | | 5/1976 | Kusche | 115/17 |
| 4,348,194 A | | 9/1982 | Walsh | 440/77 |
| 4,600,396 A | | 7/1986 | Crane et al. | 440/77 |
| 4,844,031 A | | 7/1989 | Boda et al. | 123/195 P |
| 4,875,883 A | | 10/1989 | Slattery | 440/77 |
| 4,927,194 A | | 5/1990 | Wagner | 292/128 |
| 5,025,763 A | | 6/1991 | Watanabe | 123/198 E |
| 5,120,248 A | * | 6/1992 | Daleiden et al. | 440/77 |
| 5,338,236 A | | 8/1994 | Dunham et al. | 440/77 |
| 6,080,025 A | | 6/2000 | Isogawa et al. | 440/77 |
| 6,179,350 B1 | | 1/2001 | Ely et al. | 292/113 |
| 6,669,517 B1 | | 12/2003 | Alby et al. | 440/77 |
| 6,682,379 B1 | | 1/2004 | Walczak et al. | 440/77 |
| 6,840,827 B2 | | 1/2005 | Vignau | 440/77 |

* cited by examiner

*Primary Examiner*—Ed Swinehart
(74) *Attorney, Agent, or Firm*—William D. Lanyi

(57) ABSTRACT

A cowl latching system is provided which facilitates the installation of a removable cowl with respect to a stationary cowl structure and allows these two components to be locked together as a result of a simple downward movement in a vertical direction of the removable cowl with respect to the stationary structure. Removal of the removable cowl is also facilitated by allowing these components to be disengaged from each other as a result of a rotation of the removable cowl relative to the stationary cowl structure after a manually operable latch is released.

20 Claims, 4 Drawing Sheets

COWL LATCHING MECHANISM FOR AN OUTBOARD MOTOR

BACKGROUND OF THE INVENTION

1. Field of the Invention

The present invention is generally related to a cowl latching mechanism and, more particularly, to a cowl latching mechanism that facilitates the removal and replacement of a removable cowl in relation to an outboard motor.

2. Description of the Prior Art

Many different types of cowl latching mechanisms are known to those skilled in the art.

U.S. Pat. No. 3,955,526, which was granted to Kusche on May 11, 1976, discloses a cowl apparatus for an outboard motor. The cowl includes separate starboard and port cowl members which are each individually, removably hinged to the rear of the engine by a pair of spaced hinged units which allow separated attachment and removal of the cowl halves.

U.S. Pat. No. 4,348,194, which was granted to Walsh on Sep. 7, 1982, discloses a cowl for an outboard motor. The cowl for a powerhead of an outboard motor includes two bottom cowl members attached together by screws which also mount a latch bracket and a hinge member. The latch bracket supports a latch mechanism which, with the hinge member serves to hold a top cowl member in place.

U.S. Pat. No. 4,600,396, which was granted to Crane et al. on Jul. 15, 1986, discloses a cowl latch for an outboard motor. The latch includes a catch mounted on one of the cowl members. A lever is pivotally attached to the other cowl member and a resilient spring is pivotally attached to the lever. The lever and spring member act to provide an overcenter action on the lever when the latch is closed. The lever includes a shield to conceal the latch assembly.

U.S. Pat. No. 4,844,031, which was granted to Boda et al. on Jul. 4, 1989, discloses a rotary latch mechanism for securing cowl sections of an outboard motor. The cowl assembly has an upper cowl section which includes various features for improving the structural integrity of the cowl assembly and for providing a water resistant seal at the joint between the cowl sections and at various points of entry of cables and other mechanical devices.

U.S. Pat. No. 4,875,833, which was granted to Slattery on Oct. 24, 1989, discloses a latch assembly for releasably securing cowl sections of an outboard motor. The assembly includes an upper cowl section and a lower cowl section and is provided with an improved latch assembly. The latch assembly incorporates a pivotable hook connected to one of the cowl sections, which is engageable with a hook engaging member provided on a catch mechanism connected to the other cowl section. Due to the presence of a compressible seal between the upper and lower cowl sections, relative vertical movement is possible therebetween, and thereby between the hook and the hook engaging member.

U.S. Pat. No. 4,927,194, which was granted to Wagner on May 22, 1990, discloses an interlock latch assembly for releasably securing cowl sections of an outboard motor. An interlock mechanism is provided for a latch assembly which releasably secures upper and lower cowl sections of an outboard motor. The interlock mechanism is movable between a locking position and a release position and is normally disposed in its locking position, such as by a coil spring. The interlock mechanism is mounted to the latch handle, which is pivotably mounted to one of the cowl sections. A hook is interconnected with the latch handle, and is engageable with a catch assembly provided on the other of the cowl sections.

U.S. Pat. No. 5,025,763, which issued to Watanabe on Jun. 25, 1991, describes a latching mechanism for an outboard motor cowl. The latching mechanism is used for connecting the top portion and tray of a cowling which surrounds an internal combustion engine of an outboard motor. A pair of keepers, one secured to the front side of the top portion of the cowling and the other secured to the rear side of the top portion, engage with a connecting mechanism secured on the front and rear sides of the tray of the cowling to connect the top portion and tray of the cowling with each other.

U.S. Pat. No. 5,120,248, which was granted to Daleiden et al. on Jun. 9, 1992, discloses a cam type latching mechanism for securing cowl sections together. A latch system for securing upper and lower cowl sections to an outboard motor is disclosed. The latch system comprises a catch assembly located at one end of the cowl assembly and a latch mechanism located at the other end of the assembly. The catch assembly includes a catch block mounted to one of the cowl sections with a catch slot formed in the catch block. A roller member is mounted to the other of the cowl sections for engaging the catch slot. The catch slot is formed so as to provide an end wall against which the roller is maintained when the cowl sections are secured together with the material of the catch block engaging the roller member to prevent relative vertical movement between the cowl sections.

U.S. Pat. No. 5,338,236, which was granted to Dunham et al. on Aug. 16, 1994, describes a latch mechanism for an outboard motor cowl assembly. A cowling comprises a first cover member including an outer surface having therein a recess, a second cover member mating with the first member, and a selectively engageable latch mechanism for securing the second member to the first member. The latch mechanism includes a latch handle which is supported by the first member which is movable in a first direction between a flush position wherein the latch handle is in the recess and is flush with the remainder of the outer surface and a non-flush position wherein the latch handle extends from the recess and which is movable in a second direction to engage and disengage the latch mechanism.

U.S. Pat. No. 6,080,025, which was granted to Isogawa et al. on Jun. 27, 2000, describes a cowling latch for an outboard motor. The latch is for an outboard motor having an upper cowling having a lower surface and a lower cowling having an upper surface. The cowling latch comprises a first latching member connected to the upper cowling and a second latching member connected to the lower cowling. The second latching member is movable between a first position in which it engages the first latching member for connecting the upper and lower cowlings and a second position in which it does not engage the first latching member.

U.S. Pat. No. 6,179,350, which was granted to Ely et al. on Jan. 30, 2001, describes a draw latch. The draw latch is intended for attaching one member to another, such as a first panel to a second panel. It is unlatched and latched by lifting the latch handle in one direction or the other about a pivot access which actuates a pawl member which is pivoted to engage and secure a first catch of a keeper, the handle being pivoted to be secured on a second catch of a keeper with the pawl being latched against a spring bias provided by a keeper member.

U.S. Pat. No. 6,669,517, which was granted to Alby et al. on Dec. 30, 2003, discloses a multiple part cowl structure for an outboard motor. The cowl comprises first and second cowl members that are independent components. A first cowl member is attachable, by a latch mechanism, to a support structure of the outboard motor. The second cowl member is attachable by a latch mechanism to both the first cowl member and the support structure.

U.S. Pat. No. 6,682,379, which was granted to Walczak et al. on Jan. 27, 2004, discloses a cowl latching system which simplifies the cowl removing process. The system provides a retainer that is attached to the outboard motor and a catch device which is attached to a cowl structure. The catch device is shaped to allow the retainer to move between first and second extension portions. The retainer is provided with first and second retention members that can each move from a retracted position to an extended position under the urging of a resilient member such as a spring. The first and second retention members can also be urged from their respective extended positions to their respective retracted positions by the movement of the first and second extension portions of the catch device when the cowl structure is installed onto the outboard motor.

U.S. Pat. No. 6,840,827, which was granted to Vignau on Jan. 11, 2005, describes an outboard engine cowling. The cowling includes an upper motor cover, a lower motor cover and a gear case that covers an engine that propels a watercraft. The upper motor cover mates with the lower motor cover and is configured to assist with alignment during assembly. The lower motor cover is configured to be assembled to one of a plurality of upper motor covers depending on engine size and each upper motor cover is configured to be assembled to one of a plurality of top caps depending on whether the engine uses an electric starter or a pull starter. An illuminator, in the form of a lamp, a removable light or a reflector, is provided on the cowling.

The patents described above are hereby expressly incorporated by reference in the description of the present invention.

It would be significantly beneficial if a latch mechanism for an outboard motor cowl could facilitate the installation of a removable cowl on the outboard motor and the removal of the removable cowl member from the outboard motor without requiring precise manipulation and insertion of one latch component into another. This is particularly important in relatively large outboard motors with large sized removable cowl structures.

SUMMARY OF THE INVENTION

A cowl latching system for an outboard motor, made in accordance with a preferred embodiment of the present invention, comprises a cam portion of the latching system which is attached to a stationary cowl structure of the outboard motor. A cam follower portion of the latching system comprises a base, an arm rotatably attached to the base, and a resilient member which is configured to urge the arm into a locking position. The base is attached to a removable cowl of the outboard motor. The cam follower portion is removable away from the locking position in response to the removable cowl being moved in a generally vertical direction toward the stationary cowl portion. The cam portion is movable out of locking engagement with the arm of the cam follower portion in response to the removable cowl being rotated relative to the stationary cowl structure of the outboard motor about a generally horizontal axis in a first direction.

A particularly preferred embodiment of the present invention further comprises a manually operable latch structure attachable to the stationary cowl structure and to the removable cowl structure. The manually operable latch structure is configured to release the removable cowl from attachment to the stationary cowl structure in order to permit the removable cowl to be rotated relative to the stationary cowl structure about the generally horizontal axis in the first direction.

The cam portion of the latching system can be formed as an integral part of the stationary cowl structure. The cam portion can comprise a first cam surface and the arm of the cam follower portion can comprise a first cam follower surface. The first cam surface is movable into contact with the first cam follower surface in response to the removable cowl being moved in the generally vertical direction toward the stationary cowl portion. The cam portion can comprise a second cam surface and the arm of the cam follower portion can comprise a second cam follower surface. The second cam surface is movable in contact with the second cam follower surface in response to the removable cowl being rotated relative to the stationary cowl structure of the outboard motor about the generally horizontal axis in a second direction. The second direction is opposite to the first direction.

The resilient member can be a spring. The cam portion can comprise a first locking surface and the cam follower portion can comprise a second locking surface. The first and second locking surfaces are configured to retain the arm in the locking position. The first locking surface is movable away from the second locking surface in response to the removable cowl being rotated relative to the stationary cowl structure of the outboard motor about the generally horizontal axis in the first direction.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
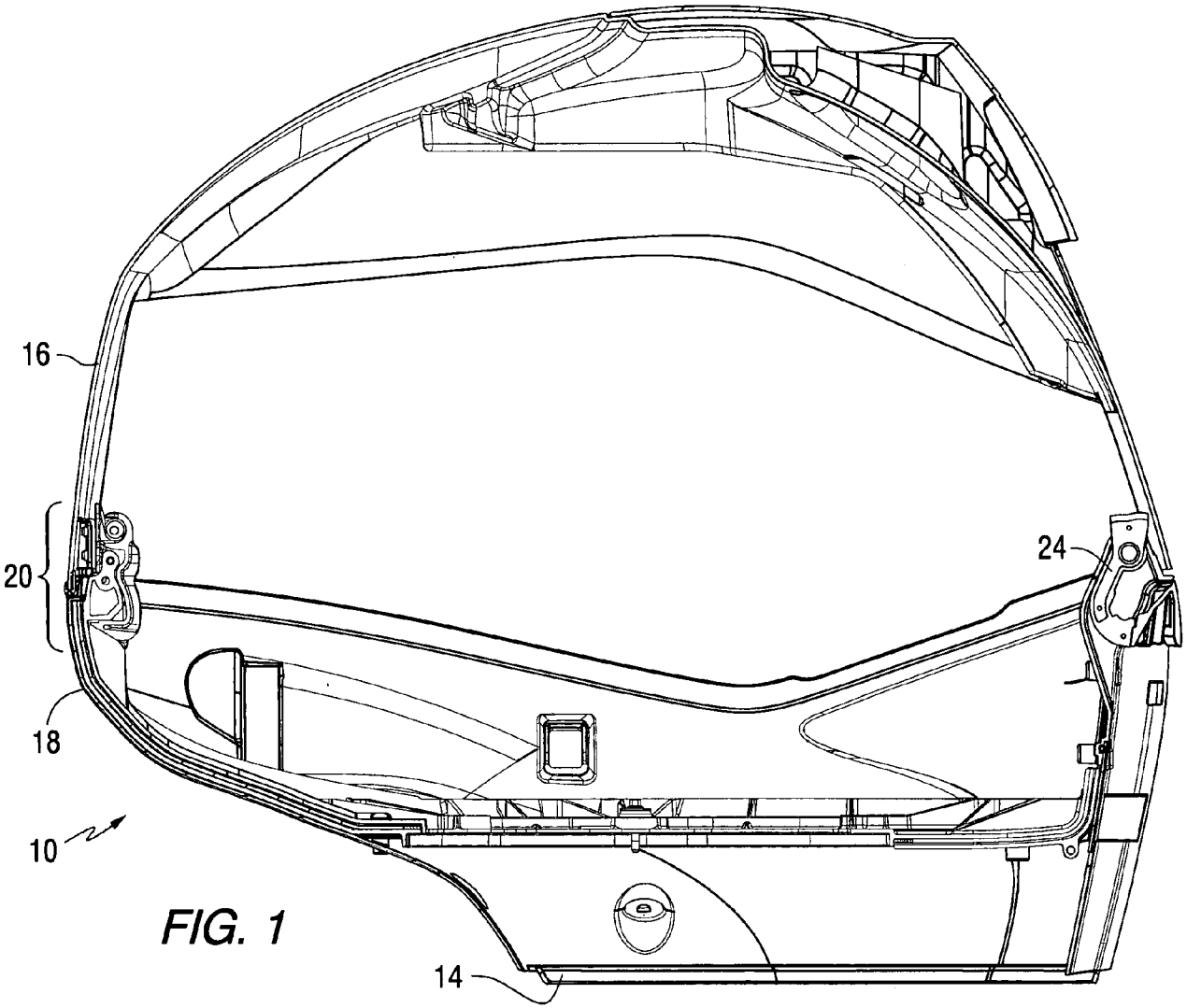
FIG. 1 is a side section view of the upper portion of an outboard motor.

Throughout the description of the preferred embodiment of the present invention, like components will be identified by like reference numerals.

FIG. 1 is a side section view of an outboard motor 10. The driveshaft housing, gear case, and propeller of the outboard motor 10 are not shown in FIG. 1, but those skilled in the art are familiar with the position of these components which are supported below the adaptor plate 14 of the outboard motor 10. A removable cowl 16 is shown in FIG. 1 attached to a stationary cowl structure 18.

Those skilled in the art of outboard motors are familiar with the fact that the removable cowl 16 is sometimes referred to as the upper cowl and the stationary cowl 18 is sometimes referred to as the lower cowl. The cowl latching system of the present invention is shown in FIG. 1 and identified by reference numeral 20. The structure of the individual components of the cowl latching system 20 will be described in greater detail below. In addition, a manually operable latch structure 24 is located at the rear portion of the outboard motor 10. The cowl latching system 20 is located at the front portion of the outboard motor.

Figure 2:
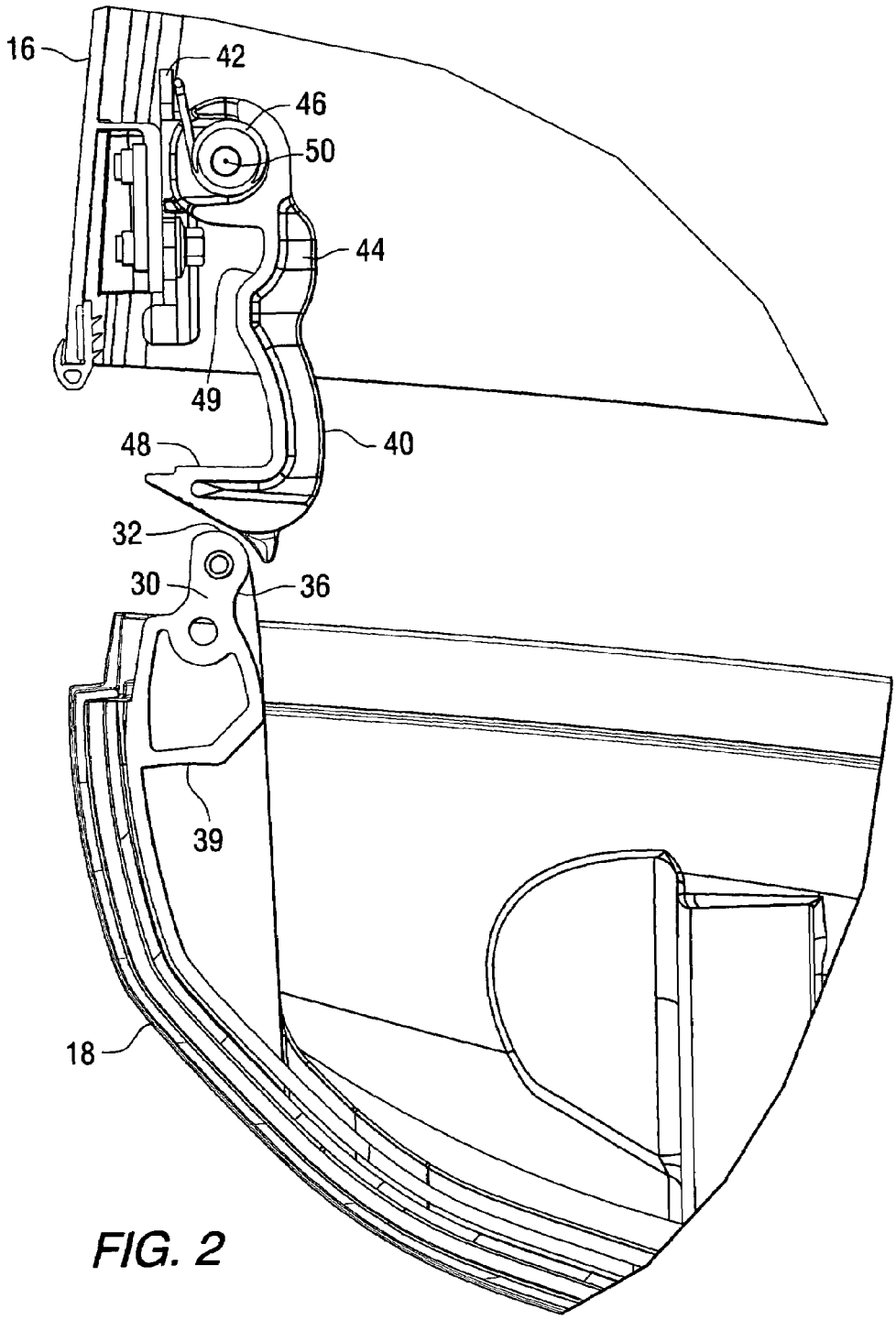
FIG. 2 is an exploded view of a removable cowl and a stationary cowl structure.

FIG. 2 is a section view of the removable cowl 16 spaced apart from and above the stationary cowl 18. When the removable cowl 16 is being attached to the stationary cowl 18, it is moved in a vertically downward direction into contact with the stationary cowl 18. This represents one of the advantages of the present invention. By simply moving the removable cowl 16 in a generally vertical direction toward the stationary cowl 18, the components of the cowl latching system 20 cooperate with each other to allow the cowl latching system 20 to engage and retain the front portion of the removable cowl 16 in an engagement with the portion of the cowl latching system 20 attached to the stationary cowl structure 18.

The cowl latching system 20 of the present invention comprises a cam portion 30 and a cam follower portion 40. The cam portion 30 is attached to the stationary cowl structure 18 of the outboard motor. The cam follower portion 40 of the latching system 20 comprises a base 42, an arm 44 which is rotatably attached to the base 42, and a resilient member 46 which is configured to urge the arm 44 into a locking position. The locking position is the position of the arm 44 shown in FIG. 2. The base 42 is attached to the removable cowl 16 of the outboard motor 10. The arm 44 of the cam follower portion 40 is movable away from the locking position shown in FIG. 2 in response to the removable cowl 16 being moved in a generally vertical direction toward the stationary cowl portion 18. This generally vertical direction is a downward direction in FIG. 2 which moves the removable cowl 16 downwardly and into contact with the stationary cowl structure 18.

The cam portion 30 is movable out of the locking engagement with the arm 44 of the cam follower portion 40 in response to the removable cowl 16 being rotated relative to the stationary cowl structure 18 about a generally horizontal axis in a first direction as will be described in greater detail below in conjunction with FIG. 4. As illustrated in FIG. 1, a manually operable latch structure 24 is attachable to the rear portion of the stationary cowl structure 18 and the removable cowl structure 16. However, it should be understood that various different types of manually operable latch structure 24 can be used in conjunction with a preferred embodiment of the present invention and, furthermore, that the present invention is not limited to the use of any particular type of manually operable latched structure. The cowl latching system of the present invention operates in conjunction with the manually operable latch structure 24 and, in a particularly preferred embodiment, both of these structures cooperate with each other to retain the movable cowl 16 in attachment with the stationary cowl structure 18.

Figure 3:
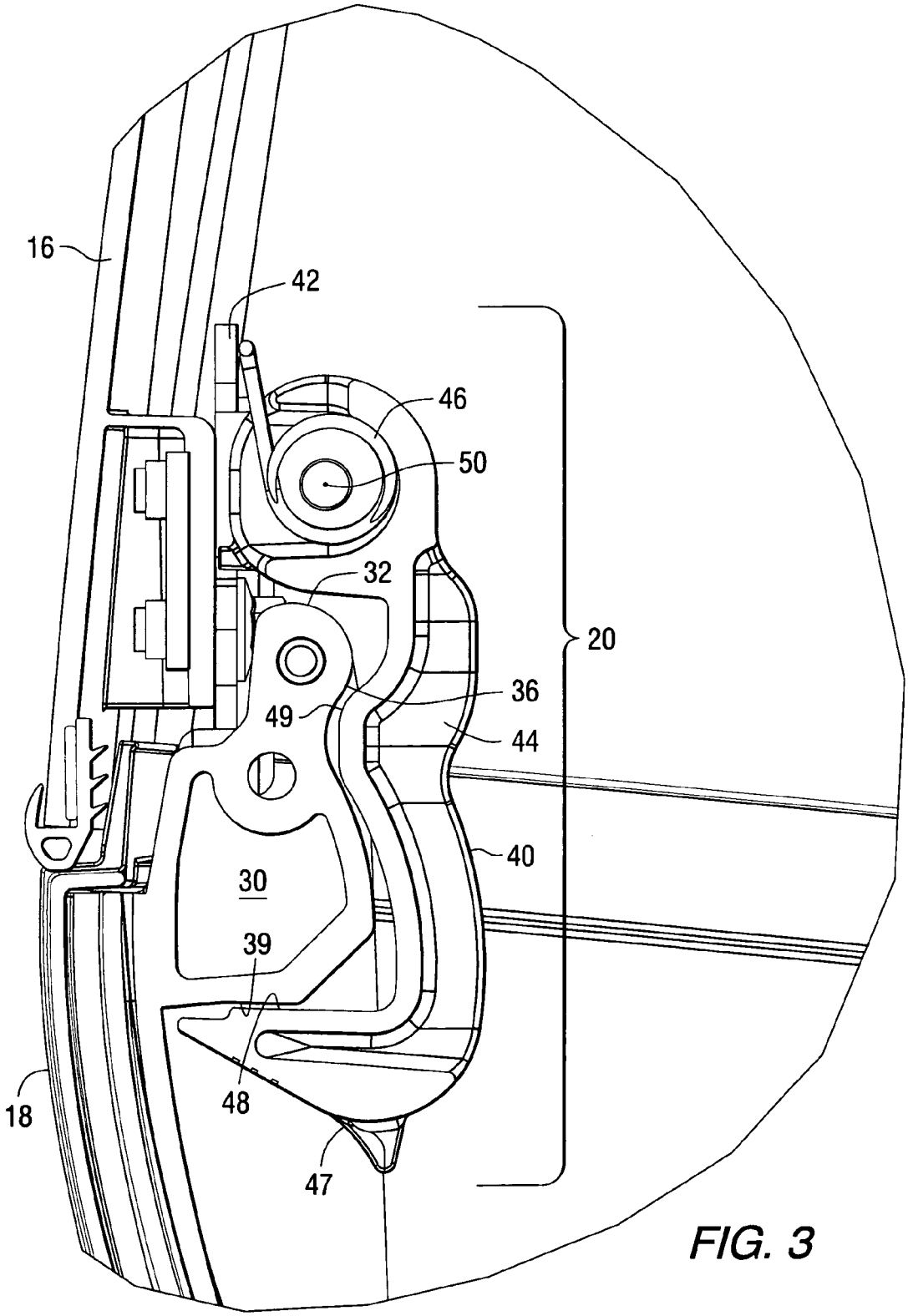
FIG. 3 is a section view showing the cam and cam follower portions of the present invention.

FIG. 3 is a section view of the cowl latching system 20 of a preferred embodiment of the present invention. In FIG. 3, the arm 44 is shown in its locking position with respect to the cam portion 30. In a particularly preferred embodiment of the present invention, the cam portion 30 is formed as an integral part of the stationary cowl structure 18, but in alternative embodiments it can be a separate component that is attached to the stationary cowl structure 18.

With continued reference to FIG. 3, the cam portion 30 comprises a first cam surface 32 and the arm 44 of the cam follower portion 40 comprises a first cam follower surface 47. The first cam surface 32 is movable in contact with the first cam follower surface 47 in response to the removable cowl 16 being moved in the generally vertical downward direction illustrated in FIG. 2 toward the stationary cowl portion 18. In other words, the first cam follower surface 47 moves into contact with the first cam surface 32 as the removable cowl 16 is lowered toward the stationary cowl structure 18 as shown in FIG. 2. This contact, which can be a sliding contact, causes the arm 44 to rotate in a counterclockwise direction about the axis identified by reference numeral 50 in FIG. 3. This moves the arm 44 into a non-locking position and permits the cam portion 30 to move upward relative to the arm 44 and achieve the locking position shown in FIG. 3 when the spring 46 urges the arm 44 in a clockwise direction subsequent to this completed movement of the removable cowl 16 in its downward direction into contact with the stationary cowl structure 18.

With continued reference to FIG. 3, the cam portion 30 also comprises a second cam surface 36. The arm 44 of the cam follower portion 40 comprises a second cam follower surface 49. The second cam surface 36 is movable in contact with the second cam follower surface 49 in response to the removable cowl 16 being rotated relative to the stationary cowl structure 18 of the outboard motor 10 about the generally horizontal axis in a second direction. The second direction is opposite to the first direction and, in FIGS. 2 and 3, the first direction is a clockwise rotation of the removable cowl 16 relative to the stationary cowl structure 18 while the second direction is a counterclockwise direction of rotation of the removable cowl 16 relative to the stationary cowl structure 18. The contact between the second cam surface 36 and the second cam follower surface 49 can be a sliding contact. As described above, the spring 46 serves as a resilient member that continually urges the arm 44 in a clockwise direction about axis 50.

With continued reference to FIG. 3, the cam portion 30 comprises a first locking surface 39 and the cam follower portion 40 comprises a second locking surface 48. The first and second locking surfaces, 39 and 48, are configured to retain the arm 44 in the locking position shown in FIG. 3 and, as a result, prevent the removal of the removable cowl 16 from the stationary cowl structure 18 when the arm 44 is in this locking position. The second locking surface 48 is movable away from the first locking surface 39 in response to the removable cowl 16 being rotated, in a counterclockwise direction in FIG. 3, relative to the stationary cowl structure 18 of the outboard motor 10 about the generally horizontal axis. As described above, this counterclockwise rotation of the removable cowl 16 is a rotation in the first direction. As a result, the second cam follower surface 49 moves against the second cam surface 36 to urge the arm 44 to rotate about its axis 50 in a counterclockwise direction so that the second locking surface 48 moves away from the first locking surface 39 and the arm 44 is urged into a non-locking position relative to the cam portion 30. This allows the operator to remove the removable cowl 16 from the stationary cowl structure 18.

Figure 4:
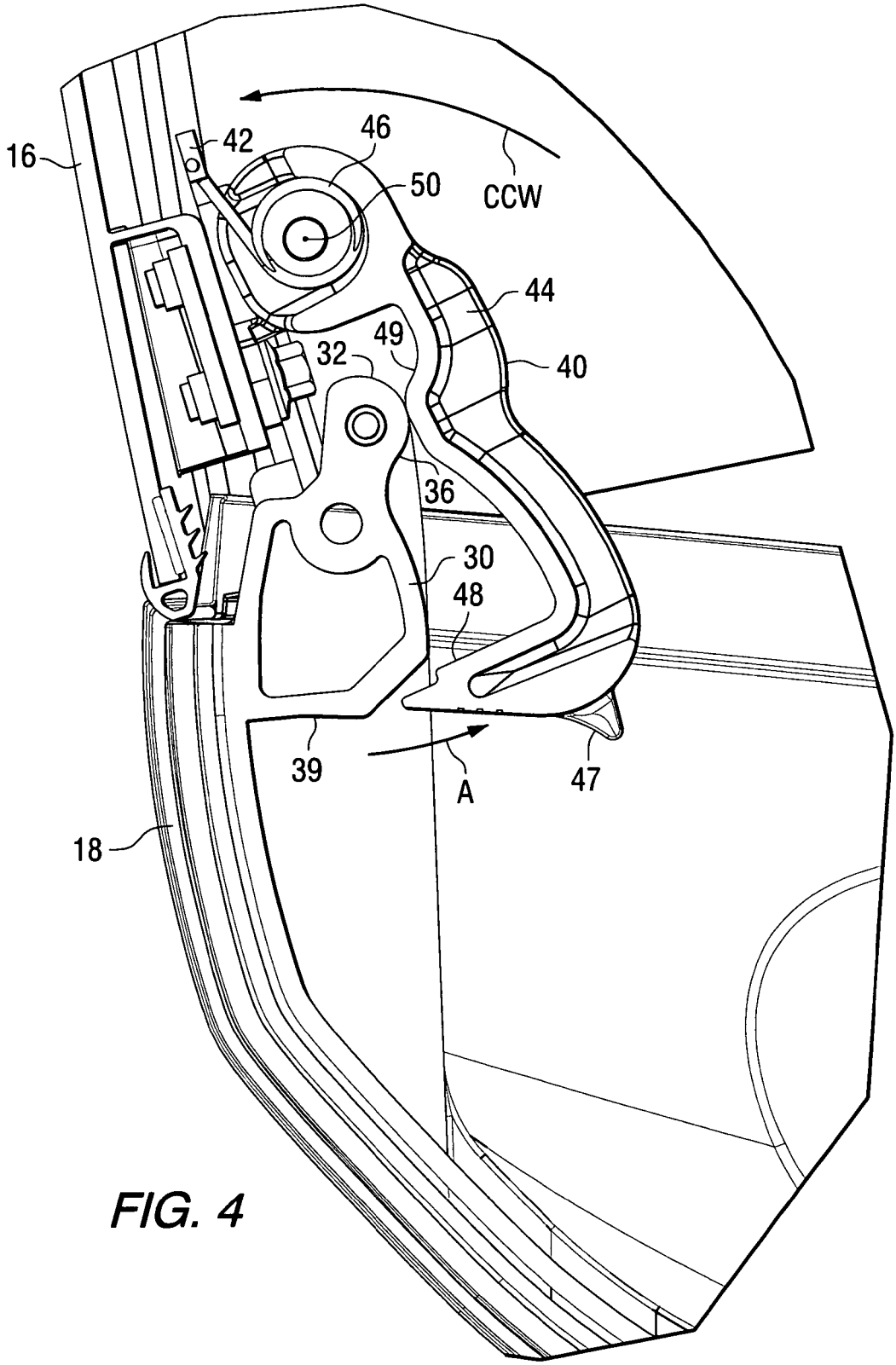
FIG. 4 is a section view showing the cowl latching system of the present invention during a disengagement maneuver.

FIG. 4 is a section view of the cowl latching system 20 as the removable cowl 16 is rotated relative to the stationary cowl structure 18. It should be understood that prior to the movement represented in FIG. 4, the manually operable latch structure 24, described in conjunction with FIG. 1, is first released by the operator. This permits the removable cowl 16 to rotate in the direction of arrow CCW in FIG. 4. This allows the second cam surface 36 to provide a force against the second cam follower surface 49 for the purpose of urging the counter clockwise rotation of the arm 44 about axis 50 against the urging of spring 46. As described above, this results in the second locking surface 48 moving away from the first locking surface 39 as represented by the directional arrow A in FIG. 4.

With reference to FIGS. 1–4, the advantages of the present invention can be seen. One advantage of the present invention is that it allows the operator to attach the removable cowl 16 to the stationary cowl structure 18 by moving the removable cowl 16 in a generally vertical direction downwardly, as illustrated in FIG. 2, toward the stationary cowl structure 18. In other words, the operator does not have to manipulate the removable cowl 16 such that one component of the latching structure is inserted into or becomes perfectly aligned with a receiving portion of that latching structure. Instead, a downward movement causes the first cam follower surface 47 to move into actuating contact with the first cam surface 32. Continued downward movement of the arm 44 with the removable cowl 16 rotates the arm 44 about its axis 50 as the first cam follower surface 47 passes over the first cam surface 32. This moves the arm 44 into a non-locking position and permits further movement of the cam 30 into engagement with the cam follower 40. Eventually, as the removable cowl 16 is moved toward its final downward position in engagement with the stationary cowl structure 18, the spring 46 urges the arm 44 into the locking position shown in FIG. 3, wherein the second locking surface 48 moves into engagement with the first locking surface 39 of the cam 30, as illustrated in FIG. 3, to retain the removable cowl 16 in its position attached to the stationary cowl structure 18.

Another advantage of the present invention is that it also facilitates removal of the removable cowl 16 from the stationary cowl structure 18. After the manually operable latch 24 is loosened, the operator can rotate the removable cowl 16, in a counterclockwise direction in the figures to allow the second cam follower surface 49 to move against the second cam surface 36 which urges the arm 44 in a counterclockwise direction against the force of the spring 46. This movement of the arm 44 disengages the first and second locking surfaces, 39 and 48, and allows the removable cowl 16 to be lifted away from the stationary cowl portion 18. The present invention facilitates both the attachment and removal of the removable cowl 16 in relation to the stationary cowl structure 18. When the removable cowl 16 is relatively large, these advantages provided by the present invention become significant because they simplify both the attachment and removal of the removable cowl 16 from the stationary cowl structure 18 and simplify the alignment of these components with each other.

Although the present invention has been described with particular specificity and illustrated to show a particularly preferred embodiment, it should be understood that alternative embodiments are also within its scope.

We claim:

1. A cowl latching system for an outboard motor, comprising:

a cam portion of said latching system attached to a stationary cowl structure of said outboard motor; and a cam follower portion of said latching system comprising a base, an arm rotatably attached to said base, and a resilient member which is configured to urge said arm into a locking position, said base being attached to a removable cowl of said outboard motor, said cam follower portion being movable away from said locking position in response to said removable cowl being moved in a generally vertical direction toward said stationary cowl portion, said cam portion being movable out of locking engagement with said arm of said cam follower portion in response to said removable cowl being rotated relative to said stationary cowl structure of said outboard motor about a generally horizontal axis in a first direction.

2. The cowl latching system of claim 1, further comprising:

a manually operable latch structure attachable to said stationary cowl structure and said removable cowl structure.

3. The cowl latching system of claim 2, wherein:

said manually operable latch structure is configured to release said movable cowl from attachment to said stationary cowl structure to permit said removable cowl to be rotated relative to said stationary cowl structure about said generally horizontal axis in said first direction.

4. The cowl latching system of claim 1, wherein:

said cam portion is formed as an integral part of said stationary cowl structure.

5. The cowl latching system of claim 1, wherein:

said cam portion comprises a first cam surface; and said arm of said cam follower portion comprises a first cam follower surface, said first cam surface being movable in contact with said first cam follower surface in response to said removable cowl being moved in said generally vertical direction toward said stationary cowl portion.

6. The cowl latching system of claim 1, wherein:

said cam portion comprises a second cam surface; and said arm of said cam follower portion comprises a second cam follower surface, said second cam surface being movable in contact with said second cam follower surface in response to said removable cowl being rotated relative to said stationary cowl structure of said outboard motor about said generally horizontal axis in a second direction, said second direction being opposite to said first direction.

7. The cowl latching system of claim 1, wherein:

said resilient member is a spring.

8. The cowl latching system of claim 1, wherein:

said cam portion comprises a first locking surface; and said cam follower portion comprises a second locking surface, said first and second locking surfaces being configured to retain said arm in said locking position.

9. The cowl latching system of claim 8, wherein:

said second locking surface is movable away from said first locking surface in response to said removable cowl being rotated relative to said stationary cowl structure of said outboard motor about said generally horizontal axis in said first direction.

10. A cowl latching system for an outboard motor, comprising:

a cam portion of said latching system attached to a stationary cowl structure of said outboard motor; and a cam follower portion of said latching system comprising a base, an arm rotatably attached to said base, and a resilient member which is configured to urge said arm into a locking position, said base being attached to a removable cowl of said outboard motor, said cam follower portion being movable away from said locking position in response to said removable cowl being moved in a generally vertical direction toward said stationary cowl portion, said cam portion comprising a first cam surface, said arm of said cam follower portion comprising a first cam follower surface, said first cam surface being movable in contact with said first cam follower surface in response to said removable cowl being moved in said generally vertical direction toward said stationary cowl portion, said cam portion being movable out of locking engagement with said arm of said cam follower portion in response to said removable cowl being rotated relative to said stationary cowl structure of said outboard motor about a generally horizontal axis in a first direction.

11. The cowl latching system of claim 10, wherein:

said cam portion is formed as an integral part of said stationary cowl structure.

12. The cowl latching system of claim 10, wherein:

said cam portion comprises a second cam surface; and said arm of said cam follower portion comprises a second cam follower surface, said second cam surface being movable in contact with said second cam follower surface in response to said removable cowl being rotated relative to said stationary cowl structure of said outboard motor about said generally horizontal axis in a second direction, said second direction being opposite to said first direction.

13. The cowl latching system of claim 12, wherein:

said resilient member is a spring.

14. The cowl latching system of claim 12, wherein:

said cam portion comprises a first locking surface; and said cam follower portion comprises a second locking surface, said first and second locking surfaces being configured to retain said arm in said locking position.

15. The cowl latching system of claim 14, wherein:

said second locking surface is movable away from said first locking surface in response to said removable cowl being rotated relative to said stationary cowl structure of said outboard motor about said generally horizontal axis in said first direction.

16. The cowl latching system of claim 15, further comprising:

a manually operable latch structure attachable to said stationary cowl structure and said removable cowl structure, said manually operable latch structure being configured to release said movable cowl from attachment to said stationary cowl structure to permit said removable cowl to be rotated relative to said stationary cowl structure about said generally horizontal axis in said first direction.

17. A cowl latching system for an outboard motor, comprising:

a cam portion of said latching system attached to a stationary cowl structure of said outboard motor; and a cam follower portion of said latching system comprising a base, an arm rotatably attached to said base, and a resilient member which is configured to urge said arm into a locking position, said base being attached to a removable cowl of said outboard motor, said cam follower portion being movable away from said locking position in response to said removable cowl being moved in a generally vertical direction toward said stationary cowl portion, said cam portion being movable out of locking engagement with said arm of said cam follower portion in response to said removable cowl being rotated relative to said stationary cowl structure of said outboard motor about a generally horizontal axis in a first direction, said cam portion comprising a first cam surface, said arm of said cam follower portion comprising a first cam follower surface, said first cam surface being movable in contact with said first cam follower surface in response to said removable cowl being moved in said generally vertical direction toward said stationary cowl portion, said cam portion comprising a second cam surface, said arm of said cam follower portion comprising a second cam follower surface, said second cam surface being movable in contact with said second cam follower surface in response to said removable cowl being rotated relative to said stationary cowl structure of said outboard motor about said generally horizontal axis in a second direction, said second direction being opposite to said first direction, said cam portion comprising a first locking surface, said cam follower portion comprising a second locking surface, said first and second locking surfaces being configured to retain said arm in said locking position, said second locking surface is movable away from said first locking surface in response to said removable cowl being rotated relative to said stationary cowl structure of said outboard motor about said generally horizontal axis in said first direction.

18. The cowl latching system of claim 17, further comprising:

a manually operable latch structure attachable to said stationary cowl structure and said removable cowl structure.

19. The cowl latching system of claim 18, wherein:

said manually operable latch structure is configured to release said movable cowl from attachment to said stationary cowl structure to permit said removable cowl to be rotated relative to said stationary cowl structure about said generally horizontal axis in said first direction.

20. The cowl latching system of claim 19, wherein:

said cam portion is formed as an integral part of said stationary cowl structure.

* * * * *